US005785226A

United States Patent [19]

Drew et al.

[11] Patent Number: 5,785,226

[45] Date of Patent: Jul. 28, 1998

[54] POWER DRIVE LOOP STAND

[75] Inventors: Wilbur Drew; John F. Drehobl, both of Dover, N.H.

[73] Assignee: Moore Business Forms, Inc., Grand Island, N.Y.

[21] Appl. No.: 659,896

[22] Filed: Jun. 7, 1996

[51] Int. Cl.[6] ..... B23Q 15/12

[52] U.S. Cl. ..... 226/45; 226/118

[58] Field of Search ..... 226/42, 44, 45, 226/118, 190, 168; 242/418.1, 420.6

[56] References Cited

U.S. PATENT DOCUMENTS

| | | | |
|---|---|---|---|
| 2,861,802 | 11/1958 | Ranney . | |
| 3,051,031 | 8/1962 | Allander | 226/44 X |
| 3,177,749 | 4/1965 | Best et al. | 226/45 |
| 3,203,635 | 8/1965 | Rayfield et al. | 226/118 X |
| 3,236,430 | 2/1966 | Gruich et al. . | |
| 3,603,522 | 9/1971 | Herrmann | 242/420.6 X |
| 4,019,694 | 4/1977 | Fare et al. | 226/118 X |
| 4,132,184 | 1/1979 | Burton | 226/44 X |
| 4,260,116 | 4/1981 | Collin . | |
| 4,488,670 | 12/1984 | Godshalk et al. . | |
| 4,504,051 | 3/1985 | Bittner et al. | 226/45 X |
| 4,542,893 | 9/1985 | Clause et al. | 226/45 X |
| 4,958,111 | 9/1990 | Gago . | |
| 5,061,233 | 10/1991 | Schultz et al. . | |
| 5,234,146 | 8/1993 | Meschi | 226/118 X |
| 5,279,536 | 1/1994 | Abreu . | |
| 5,560,527 | 10/1996 | Meschi | 226/118 X |

FOREIGN PATENT DOCUMENTS

| | | | |
|---|---|---|---|
| 287802 | 10/1988 | European Pat. Off. | 242/418.1 |
| 1089068 | 9/1960 | Germany | 242/420.6 |
| 672129 | 7/1979 | U.S.S.R. | 226/118 |

*Primary Examiner*—Daniel P. Stodola
*Assistant Examiner*—Gregory J. Strimbu
*Attorney, Agent, or Firm*—Nixon & Vanderhye, P.C.

[57] ABSTRACT

A powered loop stand includes a frame having a base, first and second substantially parallel substantially vertical columns attached at their bottoms to the base, and at least one across support between the columns. A driven roller is supported for rotation about a substantially horizontal axis by the columns adjacent the top of each, typically between about four and five feet from the base. A number (e.g. three) of vertically spaced loop sensors are mounted by the frame between the columns so that their positions with respect to the driven roller are adjustable, e.g. mounted by vertical support with a bracket or collar frictionally engaging the support. A variable speed electric motor having an output shaft with a drive pulley is mounted within the column and a drive belt directly engages a peripheral surface of the roller and the pulley to drive the roller. The sensors are operatively connected to the motor for controlling its speed of operation. An adjustable outfeed roller may be mounted to the columns below the driven roller.

12 Claims, 4 Drawing Sheets

POWER DRIVE LOOP STAND

BACKGROUND AND SUMMARY OF THE INVENTION

In the handling of webs, particularly in the handling of paper webs that are fed from a source of supply to a utilization device (such as a printer, burster, or the like) the speed and uniformity requirements for the supply of the web to the utilization device may vary over a fairly wide range. In order to accommodate this, a separate stand alone web feeding device is preferably utilized, such as shown in U.S. Pat. No. 5,234,146. Such a device needs to have a power driven roller which is capable of forming the web into a loop, and sensors for sensing the loop, and controlling the speed of operation of the motor so that an effective loop is always provided, and/or so that the utilization device will not break the web, or the web will not loop out of control.

According to the present invention a power driven loop stand is provided which is particularly advantageous. It is desirable that loop stands take up a minimum of floor space, be able to accommodate different utilization devices, be able to accommodate different sources of supply of the web for feeding by the loop stand, and to mount the components in a compact yet readily accessible manner. All these objectives are achieved according to the present invention in a simple and straightforward manner.

According to one aspect of the present invention a powered loop stand for a web is provided comprising the following components: A frame comprising: a base; and first and second substantially parallel substantially vertical columns each having a top and a bottom, the columns attached to the base at the bottom of each. A driven roller supported for rotation about a substantially horizontal axis by the columns adjacent the top of each column. A plurality of vertically spaced loop sensors mounted by the frame between the columns so that the positions thereof with respect to the driven roller are adjustable, for sensing a loop in a web. And a motor mounted on the frame for powering the driven roller.

Typically a plurality of hold down rollers are mounted on the tops of the columns for engaging a web passing over the driven roller. Also a pair of adjustable guides may be mounted on the driven roller for rotation therewith and for guiding movement of a web between them.

The plurality of loop sensors may comprise three loop sensors, each being at least vertically adjustable. For example, a vertical support (such as a bar or a rod) may be mounted by the frame and each of the loop sensors—such as optical sensors—may be mounted by a bracket or collar to the vertical support which bracket or collar frictionally engages the support so that it can be moved by the application of a vertical force to any desired position along the support, but will be retained in the position to which it was moved.

The motor is preferably mounted substantially completely within the first column and preferably comprises a variable speed, reversible, electric motor including a drive pulley connected to the motor's output shaft. The driven roller includes a peripheral surface, and a drive belt preferably directly engages the pulley and the peripheral surface of the driven roller so that rotation of the motor output shaft drives the driven roller. The sensors are operatively connected to the motor for controlling the speed of operation thereof.

According to another aspect of the present invention a powered loop stand for a web is provided comprising the following components: A frame consisting essentially of (that is substantially only of): a base; first and second substantially parallel substantially vertical columns each having a top and a bottom, the columns attached to the base at the bottom of each; and at least one cross support extending between the base and the tops of the columns. A driven roller supported for rotation about a substantially horizontal axis by the columns adjacent the top of each. A plurality of vertically spaced loop sensors mounted by the frame. And a motor mounted substantially completely within the frame first column for powering the driven roller.

The at least one cross support may comprise a single substantially horizontal cross support extending between the columns, and the columns may mount the driven roller so that it is between about 4–5 feet above the base. The details of the roller, sensors, and accessory components may be as described above.

According to yet another aspect of the present invention a powered loop stand for a web is provided comprising the following components: A frame comprising: a base; and first and second substantially parallel substantially vertical columns each having a top and a bottom, the columns attached to the base at the bottom of each. A driven roller supported for rotation about a substantially horizontal axis by the columns adjacent the top of each. A motor mounted by the frame for powering the driven roller. And a substantially horizontally extending outfeed roller adjustably mounted to the columns below the driven roller. The outfeed roller allows for the proper paper height into various different utilization machines, and the outfeed roller may be used with or without loop sensors. Preferably the outfeed roller is mounted by a first substantially vertical plate mounted to the first column and having a plurality of substantially circular vertically spaced openings therein, and a second substantially vertical plate mounted to the second column and having a plurality of open ended vertically spaced slots therein, substantially vertically aligned with the circular openings in the first plate. The outfeed roller has first and second end posts for mounting in one of the circular openings and in the aligned one of the slots.

The frame is preferably formed by individual components that are releasably connected together, such as by nuts and bolts so that it may be disassembled and shipped in a 10 in.×10 in.×5 ft. package, and easily assembled once unpacked. The stand also is relatively lightweight, e.g. only about 70 pounds. The motor may be a reversible motor with a switch mounted on the first column to reverse the motor direction to allow the paper web to turn over and change direction. The frame is also particularly adapted for use with a forms cart, such as shown in U.S. Pat. No. 5,061,233.

It is a primary object of the present invention to provide a simple yet effective power driven loop stand. This and other objects of the invention will become clear from an inspection of the detailed description of the invention and from the appended claims.

DETAILED DESCRIPTION OF THE DRAWINGS

Figure 1:
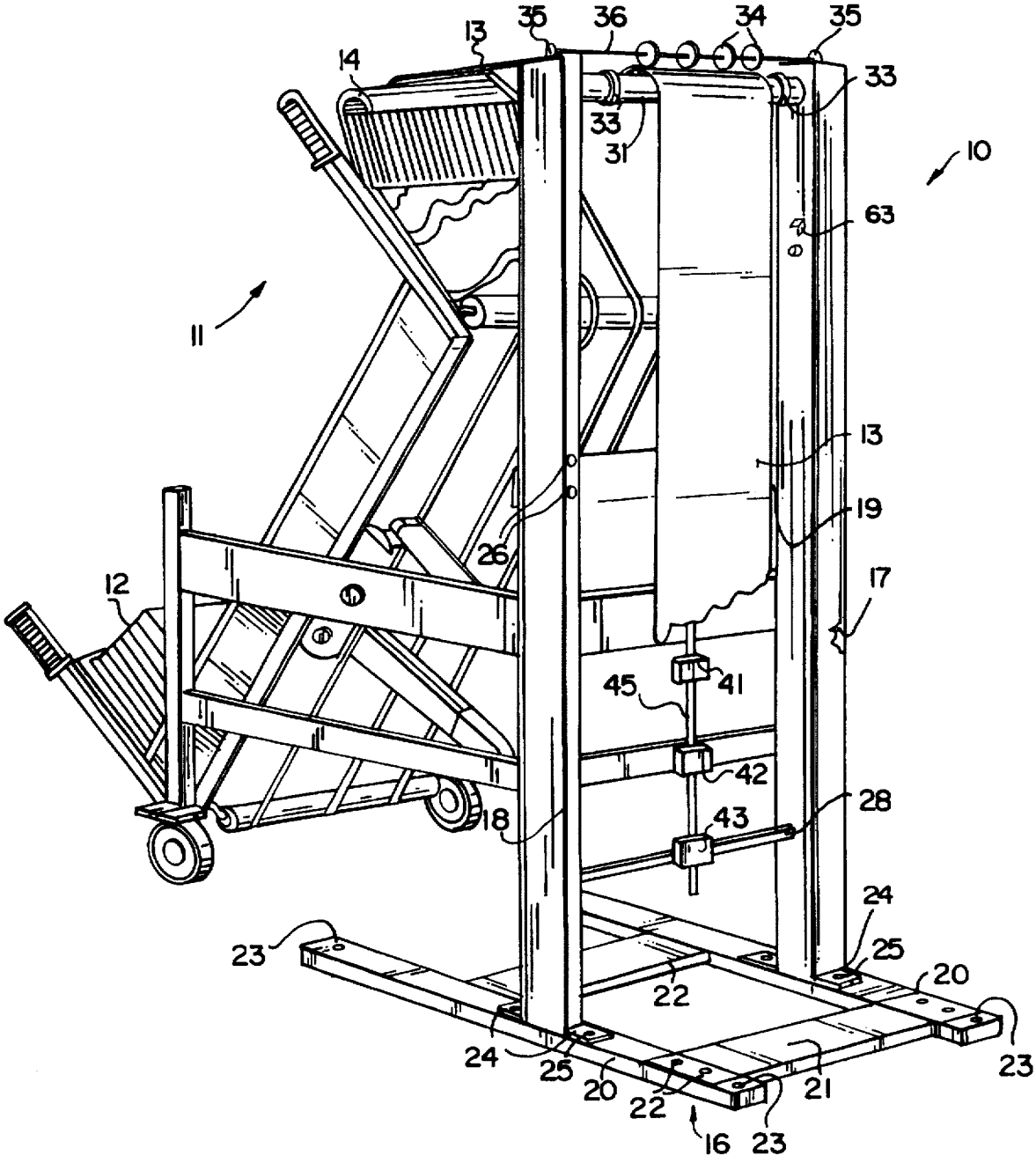
FIG. 1 is a front perspective view of an exemplary power driven loop stand according to the present invention, shown in cooperation with a conventional tilt cart.
Figure 2:
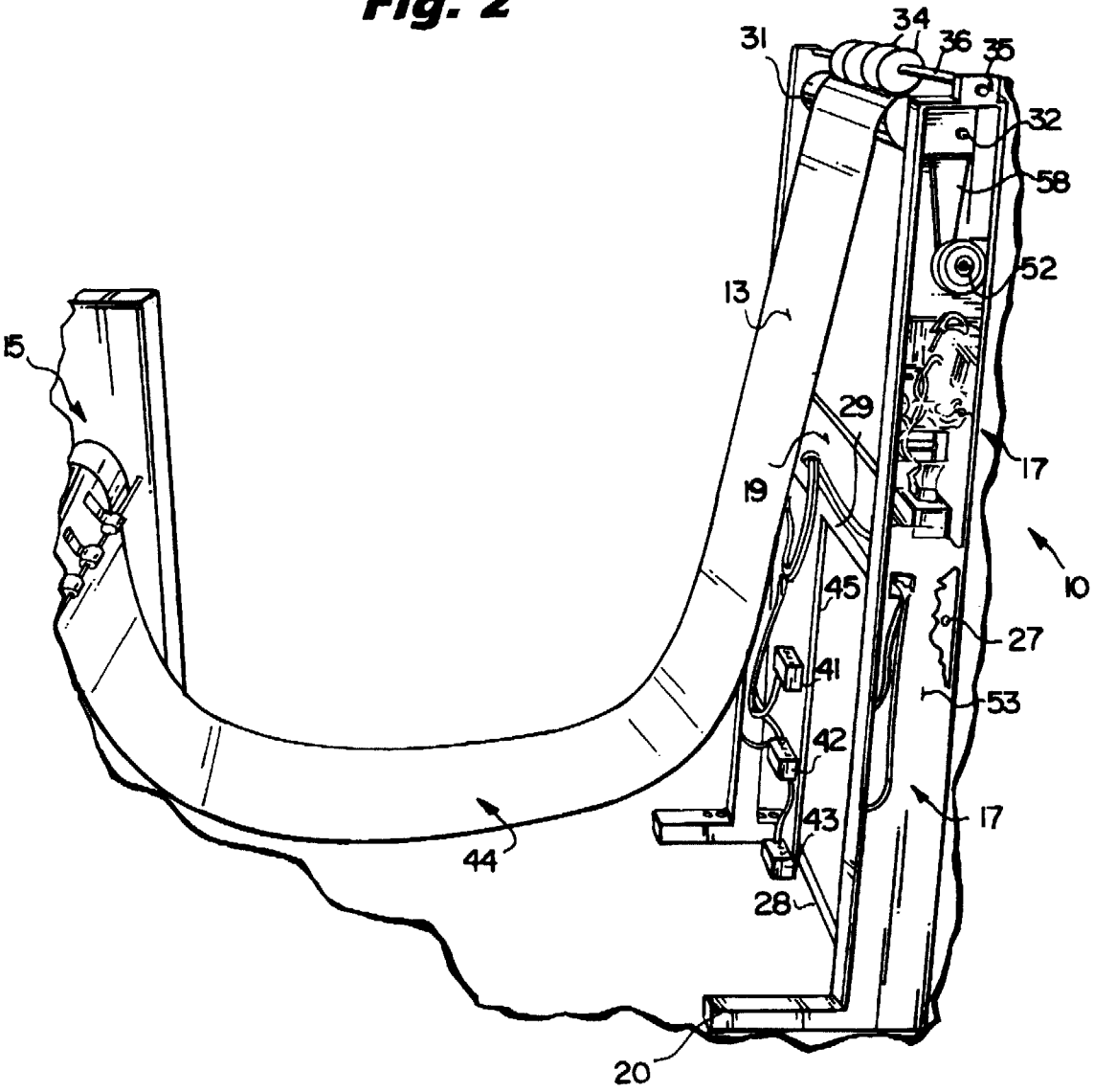
FIG. 2 is a side perspective view, taken from the opposite side of that seen in FIG. 1, of the power driven loop stand of FIG. 1, and showing a web loop that is typically formed thereby when cooperating with a utilization machine.

An exemplary power driven loop stand according to the present invention is shown generally by reference numeral 10 in FIGS. 1 and 2, in FIG. 1 being shown in association with a conventional tilt cart 11 (such as shown in U.S. Pat. No. 5,061,233) which contains a continuous supply of folded forms 12 which are taken off in the form of a web 13 over a front surface 14 of the tilt cart 11. The web 13 preferably is of paper, which will be printed, burst (e.g. along the fold lines or perforations of the forms 12) or otherwise acted upon by a utilization machine shown schematically at 15 in FIG. 2 to which the web 13 is fed by the stand 10.

One of the main components of the stand 10 is a frame which includes a base 16, first and second substantially parallel substantially vertical columns 17, 18, and desirably at least one cross support 19. All of the components 16–19 preferably are made of metal, such as sheet steel, and preferably the components are releasably attached together. For example, the base 16 may comprise a pair of feet 20 with a pair of cross braces 21, 22 connecting the feet 20, the cross braces 21, 22 bolted to, making an interference with, or otherwise releasably connected to the feet 20, for example, as indicated by the bolts 22' for the cross brace 21. The feet 20 typically include holes 23 through which bolts or other fastening devices may be passed to secure the feet 20 to the floor.

The columns 17, 18 may be bolted—as indicated by flanges 24 and bolts 25 for each—to the feet 20, and the cross brace 19 may be bolted—as indicated by bolts 26 in FIG. 1, and 27 in FIG. 2—to the columns 18, 17, respectively. While a single cross brace 19 is preferably provided, other cross braces may be used. Also, typically a rod or bar 28 extends between the columns 17, 18. The rod or bar 28 is not primarily a brace, but rather is primarily for mounting sensors, as will be hereinafter described, as is the rod or bar 29. When the frame components 16–19 (and other components) of the stand 10 are disassembled, stand 10 may be packaged in a package having dimensions as small as 10 in.×10 in.×5 ft., and a weight of only about 70 pounds.

Figure 3:
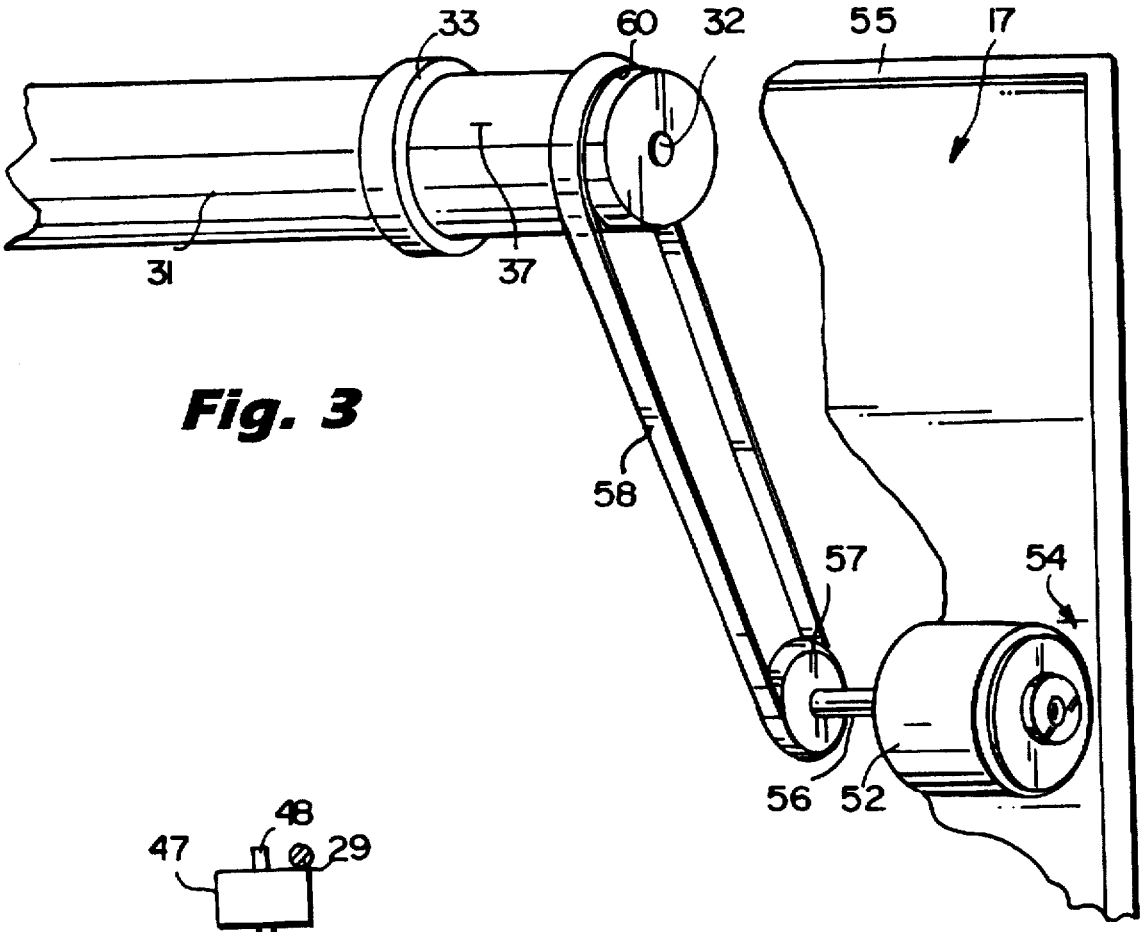
FIG. 3 is a detail perspective schematic view showing the cooperation between the motor and driven roller for the loop stand of FIGS. 1 and 2.

The stand 10 further comprises a driven roller 31 supported for rotation about a substantially horizontal axis by the columns 17, 18 adjacent the top of each, as seen in FIGS. 1 and 2. As seen in FIGS. 2 and 3, the roller 31, which preferably is of metal but may be of rubber or rubber coated, includes shaft stubs 32 extending outwardly from the ends thereof which are received by bearings of conventional construction in the columns 17, 18. Typically the columns 17, 18 are dimensioned and the roller 31 is positioned so that the roller 31 is vertically spaced between about 4–5 feet from the base 16, and in a convenient location to receive the web 13 from the tilt cart 11, as seen in FIG. 1.

Preferably the driven roller 31 has a pair of adjustable guides 33 mounted thereon for rotation therewith, for guiding movement of the web 13 therebetween. For example, the guides 33—as illustrated in FIGS. 1 through 3—may comprise rings which make a friction fit with the roller 31 and can be moved to any position desired along the length of the roller 31 depending upon web 13 width. For example, the rings 13 may be rubber.

Also, in order to insure proper engagement of the web 13 so that it will be driven by the roller 31, some sort of a hold down mechanism is utilized with the roller 31. The hold down mechanism may comprise spring or gravity biased arms, slides, rollers, or the like. In the particular embodiment illustrated in FIGS. 1 and 2, the hold down mechanism simply comprises a plurality of relatively rigid (e.g. hard plastic) hold down rollers 34 mounted upon the tops of the columns 17, 18, e.g. by brackets 35 which support the roller shaft 36 for rotation about an axis substantially parallel to the that of the roller 31. The brackets 35 and shaft 36 typically mount the rollers 34 so that they are spaced from the external periphery 37 of the driven roller 31 a distance slightly greater than the thickness of the web 13, or they may be spring biased toward engagement with surface 37.

Figure 4:
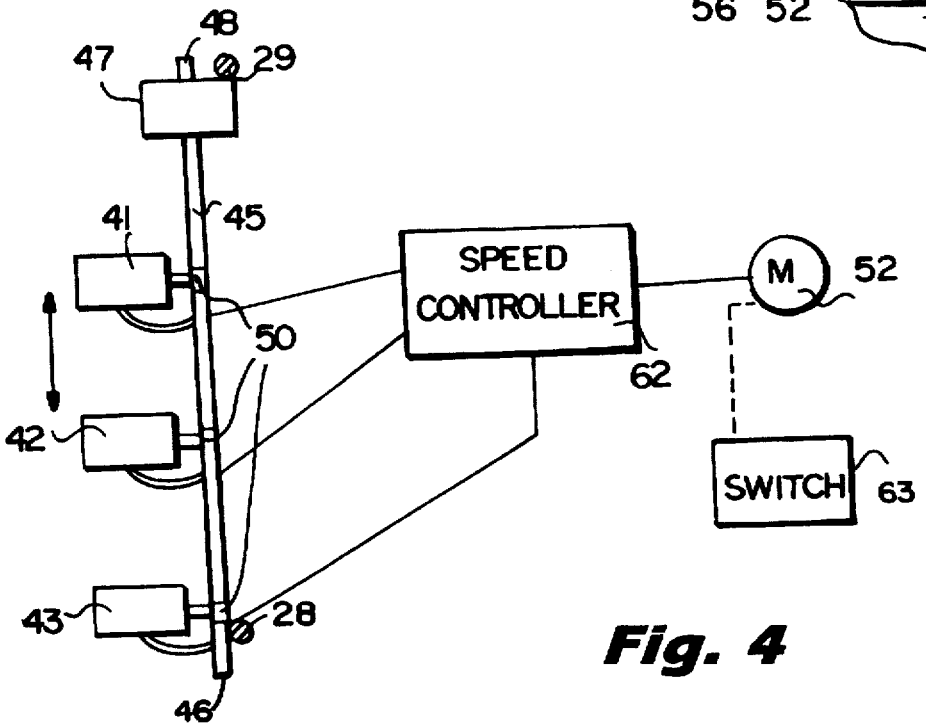
FIG. 4 is a detail view partly in cross section and partly in elevation, of a mounting for the loop sensors of the stand of FIGS. 1 and 2, and showing schematic connection thereof to the motor.

The stand 10 also comprises a plurality of vertically spaced loop sensors, such as the sensors 41, 42, 43 illustrated in FIGS. 1, 2, and 4. The sensors 41 through 43 may be any suitable type of proximity sensors for sensing the presence of the web 13 loop 44 (see FIG. 2). In the preferred embodiment the loop sensors 41–43 are conventional optical sensors which shine a beam of light in the direction of the loop 44 and detect if the light is reflected back.

The sensors 41–43 (which may comprise two, four, or more sensors in some embodiments) are vertically spaced from each other as illustrated in FIGS. 1, 2, and 3 and are mounted between the columns 17, 18 so that the positions thereof with respect to the driven roller 31 are adjustable. This adjustable mounting may be provided, for example, as seen most clearly in FIG. 4, by a vertical support element (typically a rod or bar) 45 which is operatively connected to the rods/bars 28, 29 extending between the columns 17,18. For example, the vertical support 45 may be welded or otherwise fixed directly to the rod 28 as seen in FIG. 4, adjacent the bottom termination 46 thereof, while positioned by a bracket or clamp 47 adjacent the top 48 thereof, the bracket or clamp 47 welded or otherwise affixed to the rod 29.

Each of the sensors 41–43 is mounted by a device—shown schematically at 50 in FIG. 4—which allows adjustment along the length of the support 45. While the adjustment mechanism may comprise any conventional mechanism, such as cooperating surface manifestations (like recesses, protrusions, detents) or the like provided on the support 45 and the structures 50, preferably the structures 50 comprise brackets or collars which surround a relatively smooth surface support 45 and make frictional engagement therewith. The frictional engagement may be continuous, such as provided by rubber or other flexible collars, or collars having spring pressed internal plungers, as long as the spring or biasing force provided by the collar 50 is sufficient to support the weight of the sensor 41–43 with which it is associated (which sensors 41–43 are typically light). Alternatively, a conventional screw or bolt may pass through each of the collars 50 and be tightenable into frictional engagement with the support 45 to hold each collar 50 in place, and loosened to allow adjustment of the position thereof by application of a vertical force to move the collar 50 along the support 45.

If desired, the sensors 41–43 may also be mounted so that they are adjustable in other manners aside from vertically. For example, they may be mounted so that they may be rotated about a vertical axis defined by the support 45 to sense a loop 44 on the opposite side of the stand 10 from that illustrated in FIGS. 1 and 2, and/or they may be mounted so that they are pivotal with respect to the collars 50 about vertical and/or horizontal axes, or the like.

The stand 10 also comprises a motor 52 (see FIGS. 2 through 4) mounted on the frame for powering the driven roller 31. The motor 52 preferably comprises a variable speed electric motor, which is connected up to a 110 volt, one amp source of electricity, or the like, and it is mounted substantially completely within the first column 17. As seen most clearly in FIGS. 2 and 3, the first column 17 preferably is formed by a metal channel which has a removable metal face plate 53, which is shown covering a lower portion of the channel forming the first column 17, in FIG. 2, but removed adjacent the top thereof. For example, the motor 52 may be mounted by a bracket 54 to a side wall 55 (see FIG. 3) of the channel forming the first column 17 so that the output shaft 56 of motor 52, which has a pulley, sprocket or gear 57 at the end thereof, extends toward the interior of the channel defined by the first column 17.

The motor 52 preferably drives the driven roll 31 by utilizing a drive element 58 that is operatively connected to the external periphery 37 of the driven roller 31, although depending upon the drive element 57 a sprocket, gear or pulley may be provided on the roller 31. In the preferred embodiment illustrated in FIGS. 2 and 3, the element 57 is a pulley, the element 58 is a flexible belt, and the flexible belt 58 directly engages the periphery 37 of the roller 31. The belt 58 is preferably of material that makes good frictional contact with the driven roller 31 periphery 37, e.g. the belt 58 may be of synthetic or natural rubber. If necessary, a groove 60 (see FIG. 3) may be provided in the periphery 37 of the roller 31 in order to properly locate the belt 58 with respect to the roller 31.

Preferably the motor 52 is reversible, and also it is controlled by a conventional speed controller, indicated schematically at 62 in FIG. 4. The sensors 41–43 are electrically connected to the speed controller 62 and thereby control the speed of operation of the motor 52. Reversal of the direction of rotation of shaft 56 of motor 52 may be effected by operating a switch, shown schematically at 63 in FIG. 1, which also may be mounted on the first column 17, e.g. on an interior face thereof as illustrated in FIG. 1.

In normal operation, if the lower sensor 43 senses the loop 44 at approximately the level thereof, it operates through the speed controller 62 to turn the motor 52 off. Where the middle sensor 42 senses the presence of the loop 44, but the bottom sensor 43 does not, the speed controller 62 is controlled so that the motor 52 operates at normal speed. If only the top sensor 41 senses the loop 44 at approximately the level thereof (i.e. the sensors 42 and 43 do not), then through the speed controller 62 the motor 52 is controlled so that it operates at maximum speed.

Figure 5:
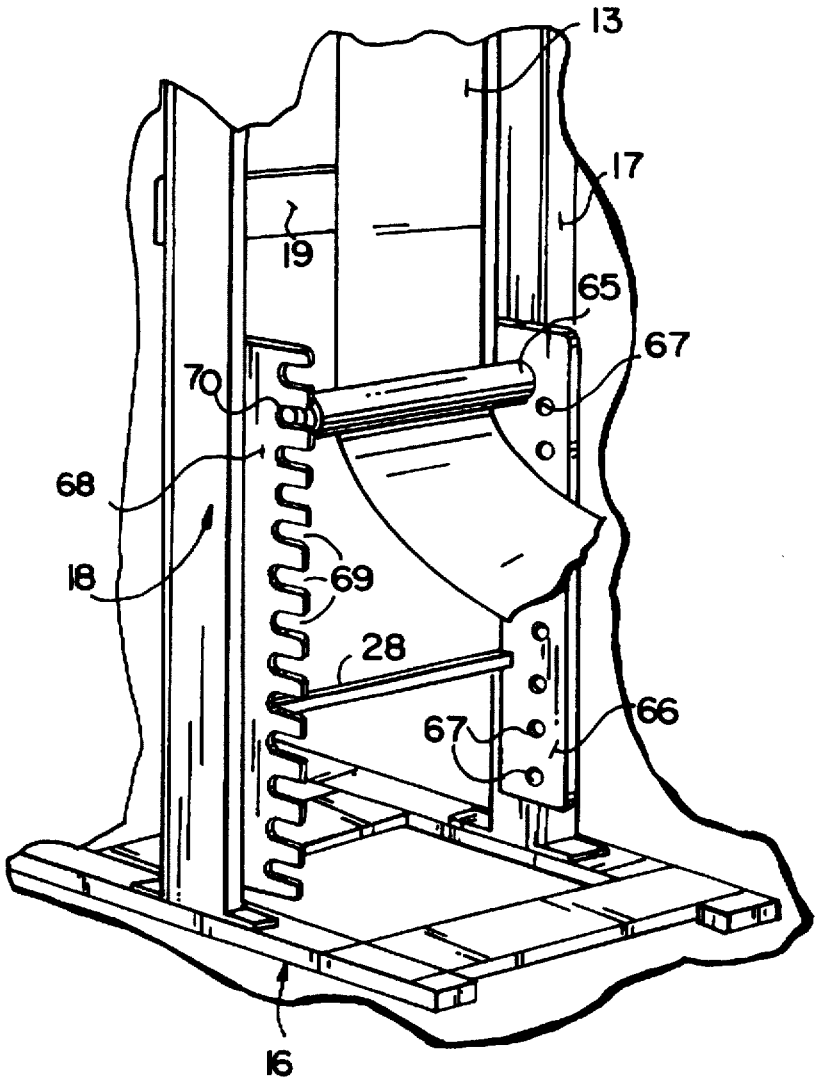
FIG. 5 is a detail front perspective view of a modification of the stand of FIG. 1, having an adjustable outfeed roller associated therewith.

Especially if floor space is tight, it may sometimes be desirable to provide a vertically adjustable outfeed roller for directing the web 13 to particular utilization machines 15. For example, as illustrated in FIG. 5 a substantially horizontally extending outfeed roller 65 is adjustably mounted to the columns 17,18 below the driven roller 31. Adjustable mounting is provided in the embodiment illustrated in FIG. 5 by a first substantially vertical plate 66 mounted (e.g. by bolts, or a weldment) to the first column 17, and having a plurality of substantially circular vertically spaced openings 67 therein. A second substantially vertical plate 68 is mounted to the second column 18 (e.g. by bolts, welding, or the like). The plate 68 has a plurality of open ended slots 69 therein which extend generally horizontally, but typically slope slightly upwardly toward their open ends. The slots 69 are vertically spaced in essentially the same manner as the openings 67, with each of the slots 69 is substantially vertically aligned with an opening 67.

The outfeed roller 65, which may be of metal, or plastic, or rubber, or metal coated rubber, includes first and second end posts, only the second end post 70 visible in FIG. 5. The end posts 70 are dimensioned to be received within the openings 67 and the slots 69 for mounting the roller 65 for rotation about a substantially horizontal axis, substantially parallel to roller 31. The outfeed roller 65 thus defines the beginning of the looping action for the web 13. Alternatively, the roller 65 may be utilized even if no looping sensors (41–43) are provided, or are deactivated, and where the stand is merely used to feed and/or direct the web 13 to specific types of utilization devices 15.

It will thus be seen that according to the present invention a simple yet effective powered loop stand is provided. While the invention has been herein shown and described in what is presently conceived to be the most practical and preferred embodiment thereof, it will be apparent to those of ordinary skill in the art that many modifications may made thereof within the scope of the invention, which scope is to be accorded the broadest interpretation of the appended claims so as to encompass all equivalent structures and devices.

What is claimed is:

1. A powered loop stand for a web, comprising:

a frame comprising: a base; and first and second substantially parallel substantially vertical columns each having a top and a bottom, the columns attached to said base at said column bottoms;

a driven roller supported for rotation about a substantially horizontal axis by said columns adjacent said column tops;

a plurality of vertically spaced loop sensors supported by said frame between said columns so that the positions of said loop sensors with respect to said driven roller are adjustable, said loop sensors for sensing a loop in a web; and a motor mounted on said frame for powering said driven roller; and wherein said motor is mounted substantially completely within said first column.

2. A powered loop stand as recited in claim 1 further comprising a plurality of hold down rollers mounted upon the tops of said columns for engaging a web passing over said driven roller.

3. A powered loop stand as recited in claim 2 further comprising a pair of adjustable guides mounted on said driven roller for rotation therewith, and for guiding movement of a web therebetween.

4. A powered loop stand as recited in claim 1 wherein said plurality of loop sensors comprises three loop sensors, each being at least vertically adjustable.

5. A powered loop stand as recited in claim 4 wherein each of said loop sensors comprises an optical sensor; and wherein said powered loop stand further comprises a substantially vertical support supported by said frame; and one of a mounting bracket and collar for each of said sensors, each said one of the bracket and collar frictionally engaging said support so that each said sensor may be moved along said support by application of a force to said sensor, but will be retained in position to which said sensor has moved with respect to said support.

6. A powered loop stand as recited in claim 1 wherein said motor comprises a variable speed electric motor having an output shaft, said shaft including a drive pulley, and wherein said driven roller includes a peripheral surface; and wherein said powered loop stand further comprises a drive belt engaging said pulley and said peripheral surface of said driven roller.

7. A powered loop stand as recited in claim 6 wherein said sensors are operatively connected to said motor for controlling the speed of operation of said motor.

8. A powered loop stand as recited in claim 7 wherein each of said loop sensors comprises an optical sensor; and wherein said powered loop stand further comprises a substantially vertical support supported by said frame; and a mounting bracket for each of said sensors, each said bracket frictionally engaging said support so that each said sensor may be moved along said support by application of a force to said sensor, but will be retained in position to which said sensor has moved with respect to said support.

9. A powered loop stand as recited in claim 7 wherein each of said loop sensors comprises an optical sensor; and wherein said powered loop stand further comprises a substantially vertical support supported by said frame; and a mounting collar for each of said sensors, each said collar frictionally engaging said support so that each said sensor may be moved along said support by application of a force to said sensor, but will be retained in position to which said sensor has moved with respect to said support.

10. A powered loop stand as recited in claim 1 wherein each of said loop sensors comprises an optical sensor; and wherein said powered loop stand further comprises a substantially vertical support supported by said frame; and a one of mounting bracket and collar for each of said sensors, each said one of the bracket and collar frictionally engaging said support so that each said sensor may be moved along said support by application of a force to said sensor, but will be retained in position to which said sensor has moved with respect to said support.

11. A powered loop stand as recited in claim 1 wherein said driven roller axis is spaced between about four and five feet from said base.

12. A powered loop stand for a web, comprising:

a frame comprising: a base; and first and second substantially parallel substantially vertical columns each having a top and a bottom, the columns attached to said base at said column bottoms;

a driven roller supported for rotation about a substantially horizontal axis by said columns adjacent said column tops;

a motor supported by said frame for powering said driven roller;

a substantially horizontally extending outfeed roller adjustably mounted to said columns below said driven roller; wherein said outfeed roller is mounted by a first substantially vertical plate mounted to said first column and having a plurality of substantially circular vertically spaced openings therein;

a second substantially vertical plate mounted to said second column and having a plurality of open ended vertically spaced slots therein, said slots substantially vertically aligned with said circular openings, respectively; and said outfeed roller having first and second end posts for mounting in one of said circular openings and in a corresponding one of said slots, respectively.

* * * * *